United States Patent [19]

Costigan

[11] 4,392,646

[45] Jul. 12, 1983

[54] SPREADING MACHINE CUTTER BOX AND CLAMP ASSEMBLY

[75] Inventor: Conrad A. Costigan, Richmond Hill, N.Y.

[73] Assignee: Spreading Machine Exchange, Inc., New York, N.Y.

[21] Appl. No.: 284,822

[22] Filed: Jul. 20, 1981

[51] Int. Cl.[3] ..... B65H 29/46

[52] U.S. Cl. ..... 270/30; 270/31; 83/484; 83/925 CC

[58] Field of Search ..... 270/30–31; 83/484, 488, 925 CC; 493/396, 402–403

[56] References Cited

U.S. PATENT DOCUMENTS

| | | | |
|---|---|---|---|
| 3,727,907 | 4/1973 | Marlin | 270/31 |
| 3,941,366 | 3/1976 | Feld | 270/31 |
| 4,073,206 | 2/1978 | Gratsch | 270/31 X |
| 4,086,835 | 5/1978 | Frederick | 270/30 X |

*Primary Examiner*—A. J. Heinz

*Attorney, Agent, or Firm*—Edward F. Levy

[57] ABSTRACT

A cutter box and clamp assembly is provided in a spreading machine for laying fabric or other sheet material on a cutting table, for the purpose of cutting off the sheet material at the end of each layer which is spread. The assembly includes a housing mounted on the spreading machine carriage, a cutter frame movably mounted in the housing, a cutter disc rotatably mounted on the cutter frame and drive apparatus for moving the cutter frame and the cutter disc, carried thereby, from one end of the housing to the other. A spring-mounted pressure bar bears against the edge of the cutter disc and the sheet material is fed between the cutter disc and the pressure bar. A clamp member operates to clamp the sheet material to the pressure bar prior to operation of the cutter disc. When the cutter frame is driven in a cutting stroke, the cutter disc rolls along the pressure bar and traverses the sheet material forcing its way through the material to perform a scoring cut and causing the material to part. After the sheet material is cut, the machine carriage moves to the opposite limit of its travel and the cutter box cooperates with a catcher assembly to place the cut end of the sheet material onto the cutting table.

10 Claims, 8 Drawing Figures

FIG. 7
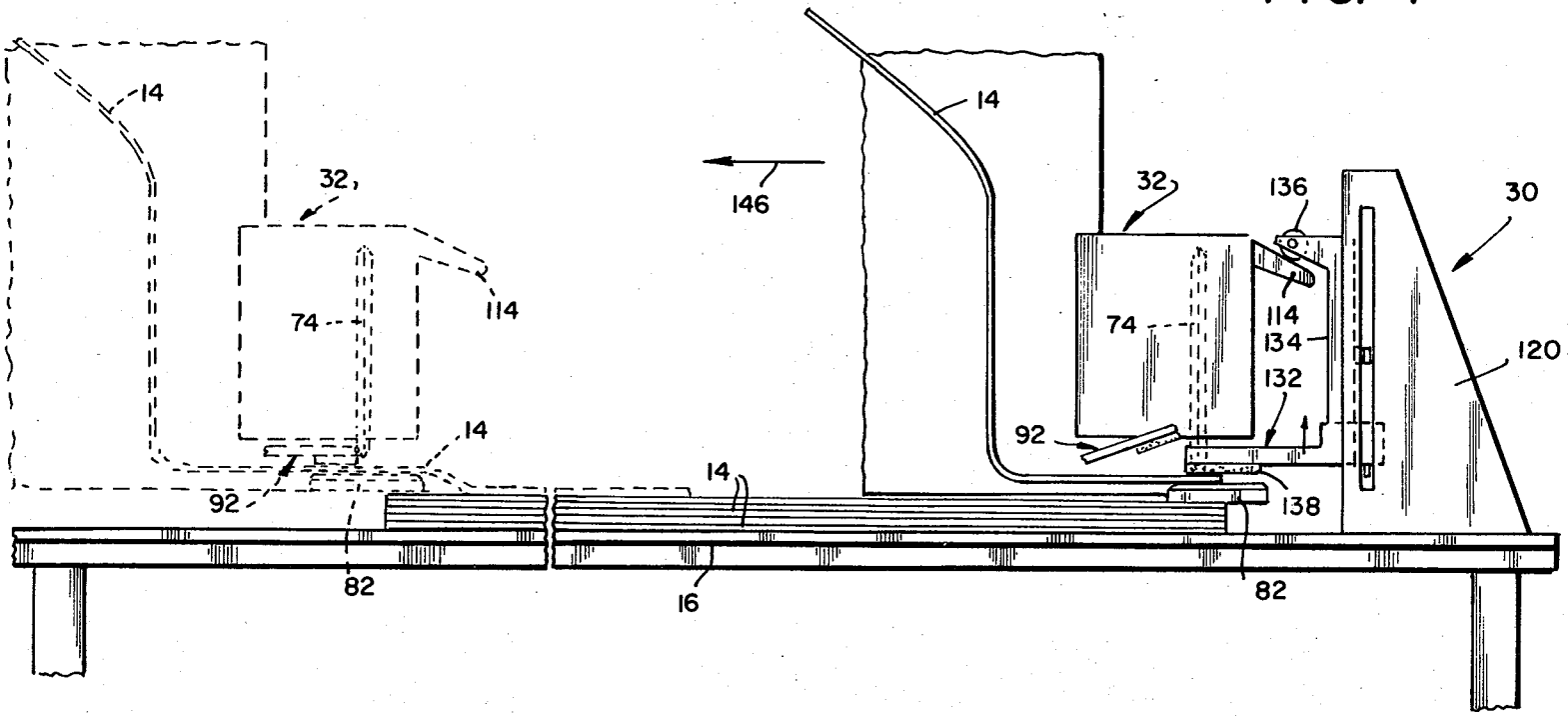
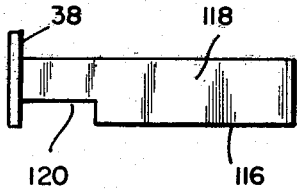
FIG. 8

SPREADING MACHINE CUTTER BOX AND CLAMP ASSEMBLY

The present invention relates to fabric spreading machines, and in particular to a novel and improved cutter box and clamp assembly for such machines.

The prior art related to the manufacture of clothing or other articles of fabric or film materials includes numerous examples of equipment which functions to spread and cut layers of sheet material, on a cutting table. Typical of such equipment are fabric spreading machines which carry a supply of fabric in roll form, and which operate to lay down on a table surface superimposed layers or sheets of the fabric as the machine carriage is moved back and forth over the table surface. At the end of each run of the machine carriage, the fabric material deposited must be cut to separate the laid-down sheets and a motor-driven cutting assembly is usually provided for this purpose.

In connection with this cutting function, our copending U.S. pat. application Ser. No. 175,254, filed Aug. 4, 1980 and now Pat. No. 4,355,794 and entitled "Spreading Machine Cutter Box Assembly", shows a cutting assembly in which the conventional circular knife blade is replaced by a cutter disc having a convexly rounded edge which forces its way through the sheet material to produce a scoring cut which is advantageous for the cutting of certain extremely thin fabrics which are impossible to cut properly with the usual slitting cut. The machine shown in this application is of the type which spreads fabric in face-to-face layers, and the construction and arrangement of the cutting assembly is such that it cannot be adapted for the spreading of fabric in layers facing in the same direction or for incorporating clamping means to clamp the ends of the layers to the table surface as they are spread. In the present invention, knife means for providing a scoring cut is incorporated in a spreading machine which spreads fabric in layers all facing in the same direction.

Conventional fabric spreading equipment usually relies entirely on one or more positive feed rollers which are rotatably driven in synchronization with the movement of the machine carriage along the table and which serve to draw fabric from a supply roller which is mounted on the carriage in order to deposit the fabric on the table surface. The use of positive feed rollers for this purpose is subject to numerous deficiencies, including the need for precise synchronization of the roller feed and the motion of the carriage in order to prevent wrinkling and distortion of the fabric being spread, and lack of exact registration between the various layers of fabric. There has been a long felt need to improve the feeding mechanism of conventional fabric spreading machines. This need has been especially apparent in spreading applications where accurate registration of each of the layers of fabric is important.

Another disadvantage of conventional spreading machines is related to the requirement for one-way or face up spreading. In this type of spreading it is required that the layers of fabric all face in the same direction. In conventional spreading machines of this type, which also include a cutting assembly for cutting off each layer of fabric by slitting, there is little or no restraint on the fabric during the cutting operation, resulting in slippage or distortion of the fabric and uneven cuts.

It is a principal object of the present invention to overcome the disadvantages of the prior art by providing an improved spreading machine cutter box and clamp assembly which is capable of spreading and cutting layers of sheet material in a manner which results in a minimum of wasted material.

Another object of the present invention is to provide a spreading machine cutter box and clamp assembly which operates to spread and cut layers of sheet material with all of the layers facing in the same direction.

Another object of the present invention is to provide a spreading machine cutter box and clamp assembly which does not rely entirely on positive feed rollers to spread the sheet material.

Another object of the present invention is to provide a spreading machine cutter box and clamp assembly which does not rely on a sharp-edged knife blade for operation, and thus eliminates the need for periodically resharpening the blade.

Still another object of the present invention is to provide a spreading machine cutter box and clamp assembly in which the contained circular knife is not driven for rotation, but rather rolls along a pressure bar as it is moved from one end of the cutter box to the other, thereby cutting the fabric fed between the knife blade and the pressure bar in a scoring action rather than in a slitting action.

A further object of the present invention is to provide a spreading machine cutter box and clamp assembly of the character described which is adapted to be used in a spreading machine for laying down fabric and face-up layers, and is also adapted to be used in cooperation with a catcher assembly which grips the ends of the spread layers and clamps them on the table surface.

In accordance with the present invention, there is provided a spreading machine cutter box and clamp assembly in which the cutter box is mounted on the carriage of a sheet material spreading machine which is adapted to travel along a cutting table. The cutter box and clamp assembly and the carriage cooperate with a catcher assembly, which is mounted on the cutting table, to spread sheet material such as fabric or plastic sheet onto the surface of the cutting table in superimposed layers, from a supply roll mounted on the carriage. A cutter frame is mounted for reciprocating sliding movement in guide ways, within the cutter box and is connected to a drive chain which is disposed to drive the cutter frame transversely across the width of the cutting table. The cutter frame carries a rotatably mounted circular cutter disc which has a convexly-rounded edge. A pressure bar is mounted on the carriage by means of helical compression springs which urge the pressure bar to bear against the rounded edge of the cutter disc.

The cutter box includes an electrically actuated clamp assembly which is mounted adjacent to the cutter disc and which operates to clamp the sheet material to the pressure bar adjacent to a first side of the cutter disc, prior to operation of the cutter disc. The cutter frame also includes a ramp member which during the operating cycle, engages the catcher assembly and lifts a portion of the catcher assembly onto the pressure bar adjacent to a second side of the cutter disc.

In use, material from the supply roll is fed between the cutter disc and the pressure bar and the carriage is driven toward the catcher assembly. The ramp member engages the catcher assembly and lifts the catcher bar onto the pressure bar. The carriage is then driven away from the catcher assembly and the catcher bar grabs and drags the end of the sheet material onto the cutting table and holds the end of the sheet material. As the carriage moves away from the catcher assembly, a positive feed roller feeds sheet material onto the cutting table. When the carriage has moved a predetermined distance, the carriage is stopped, the clamp assembly is actuated, and the cutter frame is driven across the width of the cutting table. As the cutter frame moves, the cutter disc rolls across the pressure bar and forces its way through the sheet material, causing it to part. The carriage is then driven a small distance further away from the catcher assembly, allowing the end of the sheet meterial to drop onto the cutting table. The carriage is then driven in the reverse direction, toward the catcher assembly. When the carriage approaches the catcher assembly, the carriage slows down, the ramp member again engages the catcher assembly and the operating cycle is repeated until the desired number of layers of sheet material have been deposited on the cutting table.

Additional objects and advantages of the invention will become apparent during the course of the following specification, when taken in connection with the accompanying drawings in which:

FIG. 7 is a side elevation view of the cutter box and clamp assembly showing a first position of the assembly in solid lines and a second position of the assembly in broken lines; and FIG. 8 is a fragmentary plan view taken along the line 8—8 of FIG. 3.

Figure 1:
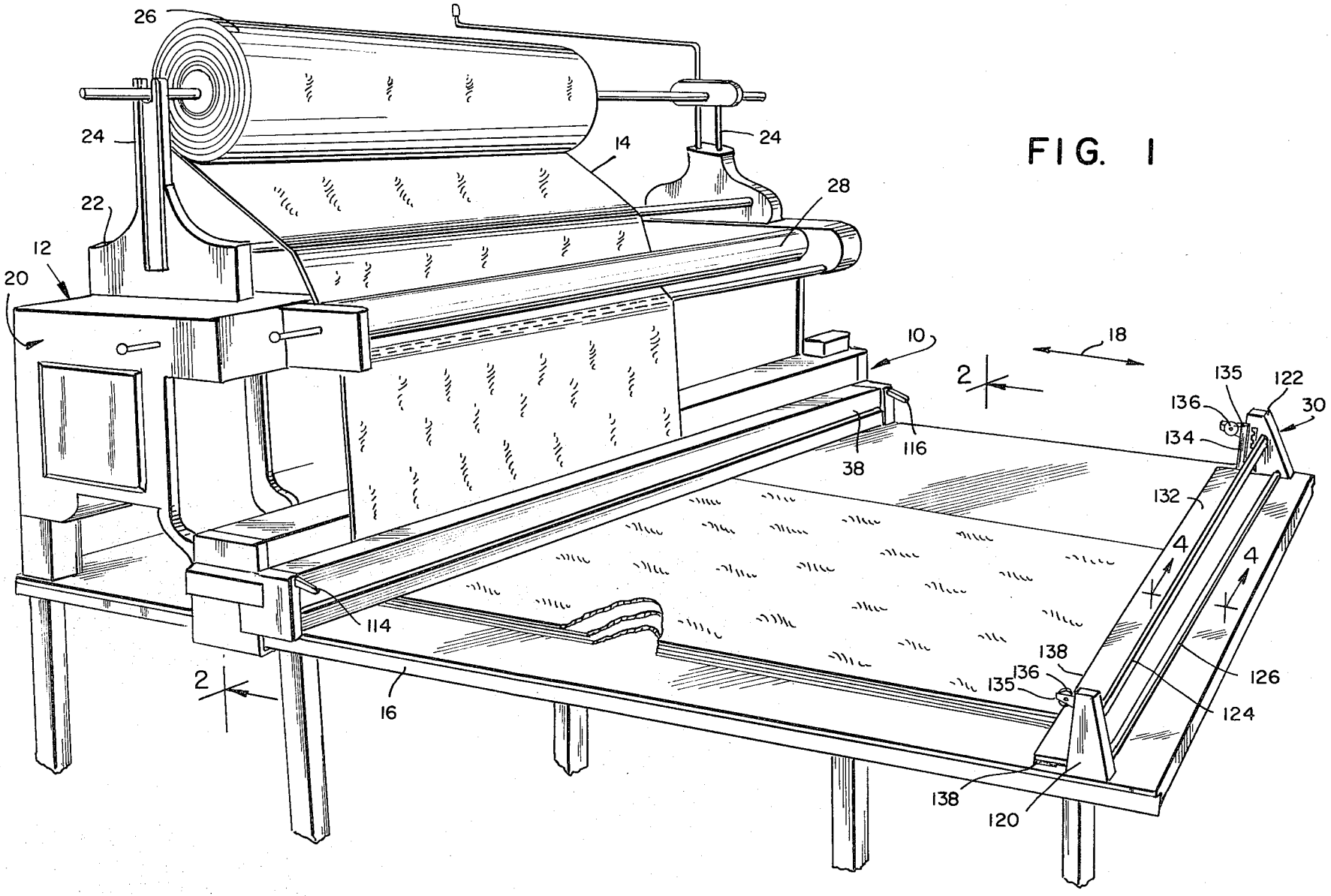
FIG. 1 is an overall perspective view of a fabric spreading machine incorporating a cutter box and clamp assembly made in accordance with the present invention, the spreading machine being shown in the course of spreading layers of fabric upon the surface of a cutting table.

Referring in detail to the drawings, there is shown in FIG. 1 a spreading machine cutter box and clamp assembly 10 made in accordance with the present invention and shown mounted on a spreading machine 12 adapted to deposit layers of fabric 14 or other sheet material onto a cutting table 16.

The cutter box and clamp assembly 10 may be used in conjunction with any suitable type of sheet material spreading apparatus. The spreading machine 12 is illustrated by way of example of such apparatus and constitutes a conventional fabric spreading machine which is mounted on wheels 17 (FIG. 2) and is motor driven to travel back and forth over the table surface as is indicated by the arrow 18 in FIG. 1. Since the machine 12 in itself forms no part of the present invention, its structure will not be described in detail other than to indicate the major components which feed the fabric to the cutter box and clamp assembly 10. The spreading machine 12 generally comprises a base frame or carriage 20 which is guided for movement lengthwise of the cutting table 16. Mounted on the carriage 20 is a frame 22 including a pair of spaced uprights 24 between which is a supply roll 26 of the fabric 14 may be rotatably mounted. The spreading machine 12 also includes a positive feed roller 28 which feeds the fabric 14 toward the cutter box and clamp assembly 10 and a catcher assembly 30.

Figure 2:
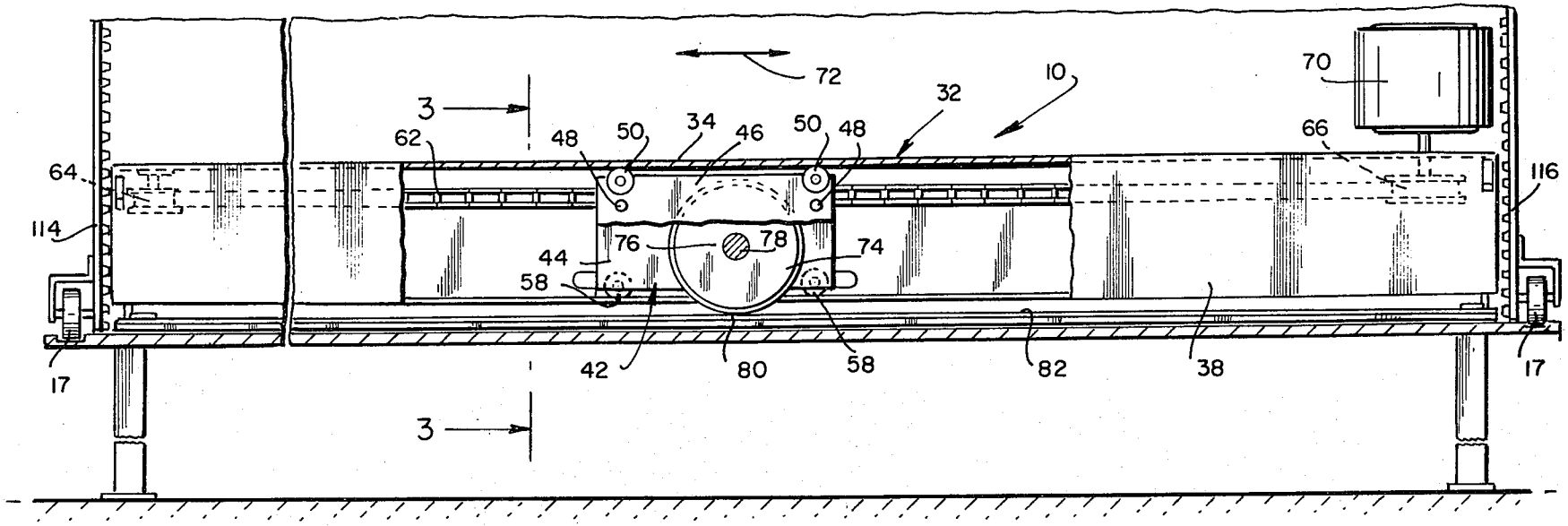
FIG. 2 is a fragmentary cross sectional view taken along the line 2—2 of FIG. 1, and showing the cutter box assembly.
Figure 3:
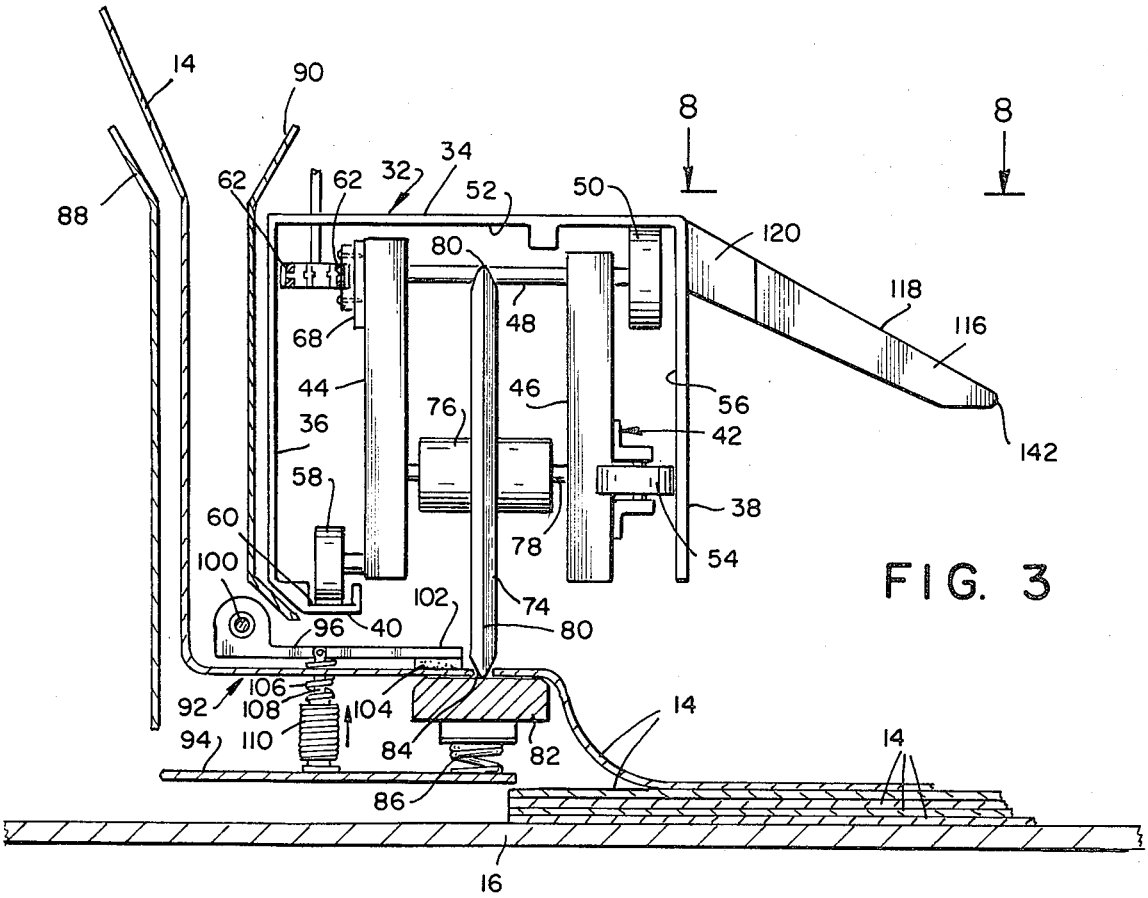
FIG. 3, is an enlarged sectional view taken along line 3—3 of FIG. 2.

As is shown in FIGS. 2, 3 and 7, the cutter box and clamp assembly 10 includes an elongated box-like support frame or housing 32 which is secured to the front end of the machine carriage 20 and extends across the width thereof. The housing 32 has a top wall 34, back wall 36, front wall 38 and bottom wall 40.

Movably mounted within the housing 32 is a cutter frame 42 comprising a pair of plates 44, 46 which are connected in spaced, parallel relationship by posts 48. As is best seen in FIG. 3, a pair of guide rollers 50 are rotatably mounted on the posts 48 outwardly of the plate 46, with their axes of rotation substantially perpendicular to the plane of the plate 46. The guide rollers 50 engage and roll along the inner surfaces 52 of the top wall 34. A pair of guide rollers 54 are also rotatably mounted on the plate 46 with their axes of rotation generally parallel to the plane of the plate 46. The guide rollers 54 engage and roll along the inner surface 56 of the front wall 38. A further pair of guide rollers 58 are mounted on the plate 44 with their axes of rotation generally perpendicular to the plane of the plate 44. The guide rollers 50 engage and roll along the inner surface 60 of the bottom wall 40.

Also located within the cutter box housing 32 is an endless drive chain 62 which is trained about a pair of sprockets 64, 66 located on opposite sides of the housing 32 adjacent to the top wall thereof. A bracket 68 is mounted on the plate 44 and is secured to an intermediate portion of the drive chain 62, as shown in FIG. 3. A reversible electric motor 70 is mounted on the machine carriage 20 and rotates the sprocket 66. The motor 70 thus operates to drive the cutter frame 42 transversely back and forth across the width of the machine carriage in the direction shown by the arrow 72 in FIG. 2.

The cutter box and clamp assembly 10 also includes a circular cutter disc 74 which is journalled by means of a sleeve 76 upon a shaft 78 which extends between the plates 44, 46. The disc 74 is mounted for free rotation within the cutter frame 42 and is so positioned that its peripheral cutting edge 80 bears against a pressure bar 82 as is shown in FIGS. 2 and 3. When the cutter frame 42 is driven transversely across the width of the machine carriage 20 the disc 74 rolls along the surface 84 of the pressure bar 82 and is rotated thereby. The disc 74 has no separate power drive for rotating it. The opposite ends of the pressure bar 82 are supported by helical compression springs, one of which being indicated by the reference numeral 86 in FIG. 3, which urge the pressure bar 82 upward against the cutter disc 74.

During use of the spreading machine 12, the sheet material 14 is fed between spaced walls 88, 90 of the carriage 20, and is then guided over the pressure bar 82.

When the cutter frame 42 is driven in a cutting stroke, the circumferential edge 80 of the cutter disc 74 bears against the pressure bar 82, under the action of the helical compression springs 86, and rotates as it is moved transversely with the cutter frame 42. When the cutter disc 74 reaches the sheet material 14 it presses the sheet material 14 firmly against the pressure bar 82 and in its rotary movement performs a scoring cut across the width of the material thereby severing the material.

In contrast to conventional cutter blades or discs which rely on a highly sharpened edge for the cutting operation, the cutter disc 74 has a rounded edge 80. This rounded edge cooperates with the pressure bar 82 to create a scoring action which causes the sheet material to part cleanly. Because the cutter disc 74 does not require the usual sharp knife edge there is no necessity for halting the operation of the machine at frequent intervals for purposes of sharpening the cutter disc.

Figure 6:
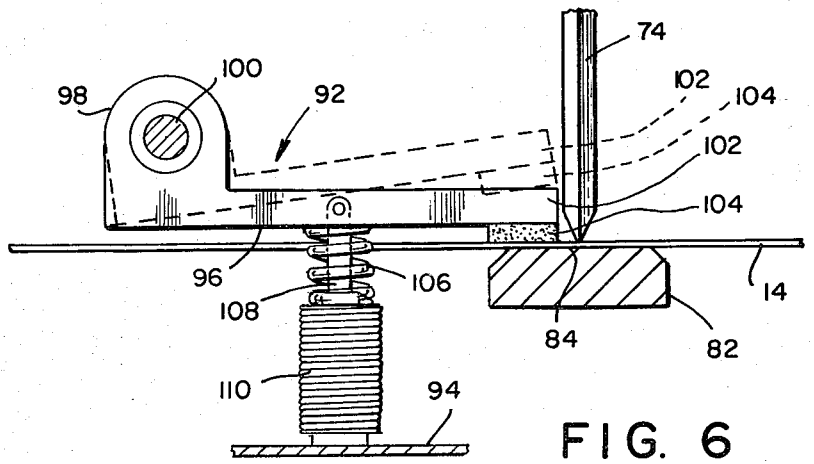
FIG. 6 is an enlarged fragmentary elevational view of a portion of the components of the cutter box and clamp assembly.

As shown in FIGS. 3 and 6, a clamp bar assembly 92 is mounted on the horizontal wall 94 of the carriage 20. The clamp bar assembly 92 includes a clamp bar 96 which has a first end 98, pivotally mounted on a shaft 100 which is secured to the carriage 20, and a free end 102 to the lower surface of which is affixed a foam rubber pad 104. A helical compression spring 106 encircles the arm 108 of a solenoid 110 and bears against the clamp bar 96, urging the clamp bar 96 upward to the position shown in broken lines in FIG. 6. When the solenoid 110 is energized, the free end 102 of clamp bar 96 is drawn downward compressing the spring 106 and moving the clamp bar 96 to the position shown in solid lines in FIG. 6 with the foam rubber pad 104 pressing the sheet material 14 against the pressure bar 82.

Mounted on opposite ends of the front wall 38 of the cutter box housing 32 are a pair of ramp members 114, 116, which cooperate with the catcher assembly 30 in a manner which will be presently described. As is shown in FIGS. 3 and 8, the ramp members 114, 116 include a downwardly sloping upper surface 118 and a recessed portion 120 which is formed close to the front wall 38.

Figure 5:
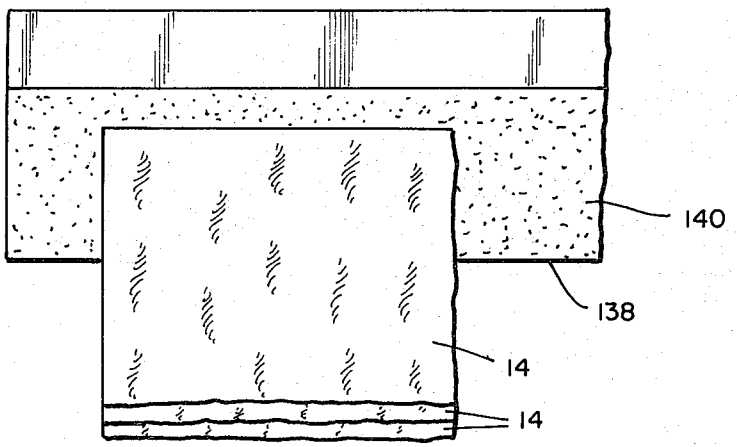
FIG. 5 is an enlarged fragmentary sectional view taken along the line 5—5 of FIG. 4, and showing the lower surface of the catcher bar.
Figure 4:
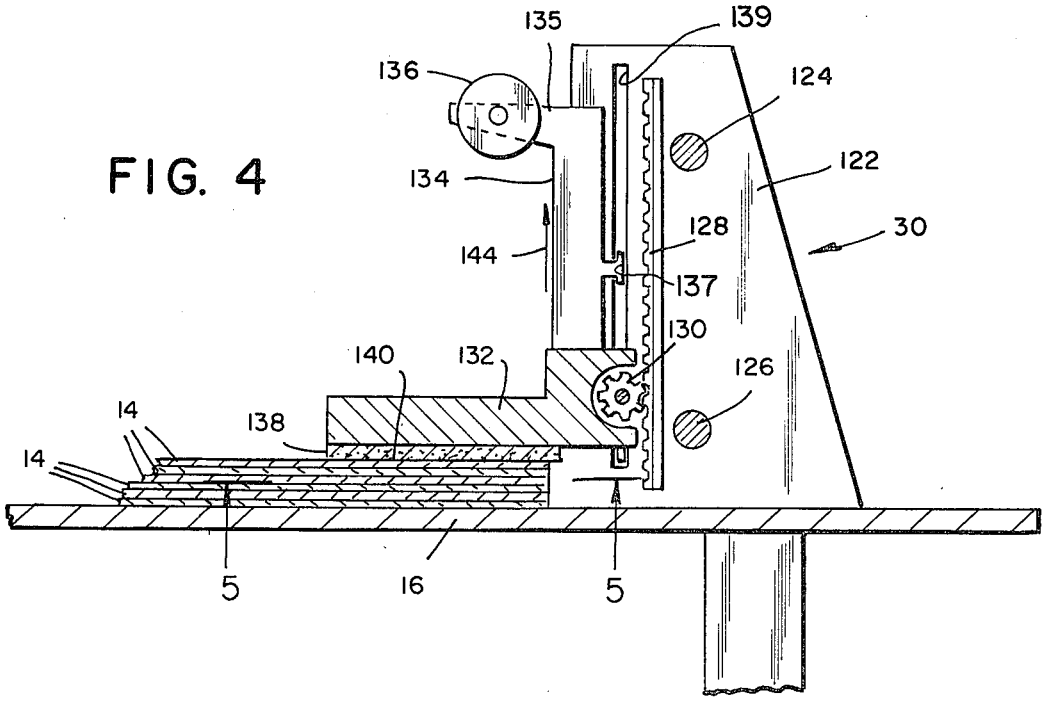
FIG. 4, is a sectional view taken along the line 4—4 of FIG. 1, and showing the catcher bar assembly.

As shown in FIGS. 1 and 4, the catcher assembly 30 includes a pair of spaced, upstanding brackets 120, 122 which are mounted on opposite sides of the table 16 and which are connected by a pair of bars 124, 126. A catcher bar 138 is mounted for vertical sliding movement between the brackets 120 and 122, the bar 138 extending transversely across the width of the table 16, as shown in FIG. 1. At each of its ends, the catcher bar 138 is secured to a respective catcher member 132, each of which is formed with an upstanding bar 134 terminating in a projecting arm 135 upon which a roller 136 is rotatably mounted. Each catcher member is also formed at each end with a longitudinally-projecting rectangular pin 137 (FIG. 4) which extends slidably within a vertical slot 139 of rectangular cross section, formed in each of the brackets 120 and 122. By such means, the catcher members 132, and the catcher bar 138 carried thereby, are guided for vertical straight-line movement relative to the fixed brackets 120, 122. The bottom surface 140 of the catcher bar 138 is preferably roughened to facilitate gripping of the sheeet material, as shown in FIG. 5.

During operation of the apparatus 10, when the carriage 20 approaches the catcher assembly 30, the tips 142 of the ramp members 114, 116 ride under the rollers 136, and, as the carriage 20 moves closer, the rollers 136 ride upward on the ramp members, thereby moving the upstanding bars 134 upwardly in the direction of the arrow 144 in FIG. 4. As the drive bars 134 are moved upward, they elevate the catcher bar 138 until the latter is slightly higher than the top surface 84 of the pressure bar 82. At this point, the rollers 136 fall into the recessed area 120 of the ramp members 114, 116, and the catcher bar 138 falls onto the sheet material 14 which rests on the pressure bar 82 as is shown in the solid line view in FIG. 7. At this time, the carriage 20 also actuates a limit switch which causes the carriage drive motor (not shown) to reverse direction and to start to drive the carriage 20 to the left as viewed in FIG. 7, in the direction of the arrow 146. The limit switch also deenergizes the solenoid 110, thereby lifting the clamp bar 96.

As the carriage 20 moves to the left, the catcher bar 138 and the end of the sheet material 14 slides off the pressure bar 82 onto the table 16 and the weight of the catcher bar 138 holds the end of the sheet material in place, thereby forming the start of a layer. During this time the solenoid 110 is deenergized and the clamp bar 96 is in the upper position shown in broken lines in FIG. 6. The sheet material is unrolled from the roll 26 as the carriage 20 moves to the left by the combined action of the positive feed roller 28 and the catcher bar 138, thereby forming a layer.

When the carriage 20 has moved a predetermined distance to the other end of the table, it actuates a limit switch which halts the motion of the carriage, energizes the solenoid 110, thereby clamping the material to the pressure bar 82, and then activates the motor 70 which drives the frame assembly 42 thereby cutting the sheet material in the manner which has been previously described. The carriage 20 is now in the position shown in broken lines in FIG. 7.

After the sheet material has been cut, the carriage 20 moves an additional predetermined distance to the left, as viewed in FIG. 7, which may be in the order of two inches. This causesthe cut end of the material to fall off the pressure bar 82 and onto the table, completing the layer.

The carriage 20 then moves to the right, as viewed in FIG. 7. During this motion the positive feed roller 28 is disconnected and does not operate, so that no fabric is spread. As the carriage 20 approaches the catcher assembly 30, the carriage 20 slows down to prevent wind forces from bunching the material. The tip 142 of the ramp member 116 engages the roller 136 lifting catcher bar 138 onto the pressure bar 82 as has been described. The solenoid 110 is again deenergized lifting the clamp bar 96 and the drive motor again starts to drive the carriage to the left, as viewed in FIG. 7 thereby starting a second layer of material.

The above cycle continues until the desired number of layers of material have been deposited on the table. After each layer of material has been deposited, the cutter box and clamp assembly 10 is raised incrementally by conventional drive means which are not shown.

This action causes the clamp bar 96 to be automatically incrementally raised to the proper height to grip and hold succeeding layers of material.

While a preferred embodiment of the invention has been shown and described herein, it is obvious that numerous additions, changes and omissions may be made in such embodiment without departing from the spirit and scope of the invention.

What is claimed is:

1. A sheet material spreading machine comprising a carriage mounted for movement along a table surface and carrying a supply of sheet material to be deposited in superimposed layers on said table surface, with each layer of sheet material deposited in an operative run of said carriage in opposite directions along said table surface, a cutter box and clamp assembly carried by said carriage and adapted to cut off the layer of sheet material deposited on the table surface at one end of each operative run of said carriage, said cutter box and clamp assembly comprising:

an elongated support member mounted on said machine carriage and extending transversely thereof, a cutter frame movably mounted on said support member, guide means on said support member for guiding movement of said cutter frame in opposite directions along said support member, drive means on said support member for moving said cutter frame along said guide means, a circular cutter member rotatably mounted for free rotation on said cutter frame in a vertical position and having an edge portion, a pressure bar mounted on said support member in a horizontally-disposed position and having a solid impermeable planar surface underlying said cutter member wherein the sheet material passes between said cutter member and said planar surface and is pressed into engagement with said planar surface by said edge portion along a cutting line, biasing means mounted on said support member and adapted to urge said pressure bar into firm engagement with said cutter member, said cutter member rotating at a speed such that said edge portion moves in a substantially non-slipping relationship with the sheet material to thereby cause said cutter member to score the sheet material fed between said cutter member and said pressure bar under rolling action of said cutter member against said pressure bar as said cutter member is carried by said cutter frame along said support member, and clamp means disposed to clamp said sheet material to said pressure bar, adjacent to the path of travel of said cutter member.

2. A sheet material spreading machine according to claim 1 in which said circular cutter member has a rounded edge portion.

3. A sheet material spreading machine according to claim 1 in which said clamp means comprises a clamp bar, means mounting said clamp bar on said support member for movement between a lowered position in which said clamp bar engages the sheet meterial overlying said pressure bar and an elevated position in which said clamp bar is spaced from said pressure bar, biasing means urging said clamp bar to said elevated position, and actuator means for moving said clamp bar to its lowered position prior to a cutting stroke, and for releasing said clamp bar after completion of said cutting stroke, whereby said clamp bar is moved by said actuator means to said elevated position.

4. A sheet material spreading machine according to claim 3 in which said actuator menas comprises an electromechanical actuator.

5. A sheet material spreading machine according to claim 4 in which said actuator means comprises a solenoid.

6. A sheet material spreading machine according to claim 1 which further includes an engagement member mounted on said support member and a catcher assembly mounted on said table surface, said engagement member being positioned to engage and lift said catcher assembly onto said pressure bar when said spreading machine carriage approaches said catcher assembly.

7. A sheet material spreading machine according to claim 6 in which said engagement member comprises an upwardly sloping ramp member having a vertical recess formed in an upper portion thereof.

8. A sheet material spreading machine according to claim 7 in which said catcher assembly comprises a support frame mounted on said table surface, an elongated catcher bar mounted for vertical movement on said support frame, and extending substantially across the width of said table, a catcher member secured to and upstanding from each end of said catcher bar, and including a roller mounted thereon, said rollers being positioned to engage and roll up said ramp members as said carriage moves toward said catcher assembly, thereby lifting said catcher members and said catcher bar until each roller engages said vertical recess in said engagement member whereupon said catcher bar is dropped onto said pressure bar.

9. A sheet material spreading machine according to claim 8 in which a lower surface of said catcher bar is roughened.

10. A sheet material spreading machine according to claim 9 in which said catcher assembly further comprises rack means mounted on said support frame and pinion means rotatably mounted on said catcher member and in mesh with said rack means.

* * * * *